US006827237B2

(12) United States Patent
Yorn et al.

(10) Patent No.: US 6,827,237 B2
(45) Date of Patent: Dec. 7, 2004

(54) BAG-IN-BOX CONTAINER FOR LIQUIDS

(75) Inventors: Kendall L. Yorn, Allen, TX (US); Frank L. Provenza, Wylie, TX (US)

(73) Assignee: Dr Pepper/Seven-up, Inc., Plano, TX (US)

( * ) Notice: Subject to any disclaimer, the term of this patent is extended or adjusted under 35 U.S.C. 154(b) by 0 days.

(21) Appl. No.: 10/257,335

(22) PCT Filed: Apr. 13, 2001

(86) PCT No.: PCT/US01/12197

§ 371 (c)(1),
(2), (4) Date: Apr. 1, 2003

(87) PCT Pub. No.: WO01/79072

PCT Pub. Date: Oct. 25, 2001

(65) Prior Publication Data

US 2003/0155372 A1 Aug. 21, 2003

Related U.S. Application Data

(60) Provisional application No. 60/197,026, filed on Apr. 13, 2000.

(51) Int. Cl.[7] ..... B65D 35/56

(52) U.S. Cl. ..... 222/105; 222/94; 222/107; 222/183; 222/185.1

(58) Field of Search ..... 222/94, 105, 107, 222/131, 183, 185.1

(56) References Cited

U.S. PATENT DOCUMENTS

| | | | | |
|---|---|---|---|---|
| 3,083,875 | A | 4/1963 | Welty et al. | 222/95 |
| 3,198,390 | A | 8/1965 | Beckman et al. | 222/105 |
| 4,165,024 | A | 8/1979 | Oswalt et al. | 222/105 |
| 5,148,939 | A | 9/1992 | Roser | 220/401 |
| 5,186,359 | A | 2/1993 | Brown et al. | 222/1 |
| 5,566,851 | A | 10/1996 | Sasaki et al. | 220/441 |
| 5,743,435 | A | 4/1998 | Tomic | 222/105 |
| 5,749,493 | A | 5/1998 | Boone et al. | 222/105 |
| 6,223,944 | B1 | 5/2001 | Gehl et al. | 222/94 |

*Primary Examiner*—J. Casimer Jacyna
(74) *Attorney, Agent, or Firm*—Cox Smith Matthews Incorporated

(57) ABSTRACT

This invention is directed to an improved bag-in-box apparatus for containing and dispensing liquids such as beverages. The interior surface of the bottom of the box (20) is preferably sloped downward toward the spout (12) of the bag (10) such that gravity helps feed the liquid toward the spout (12). In lieu of or in conjunction with slopes, the interior bottom surface of the box (120, 130, 150, 140, 160) may have terraces (34), curves (132, 134), corrugations (152), fan-like ridges (142), or beams (162). The present invention thereby reduces the amount of residual liquid as the liquid is withdrawn from the bag (10) without the need for an evacuation strip or a special slanted rack. Although the primary intended application of the present invention is in bag-in-box packages for containing and dispensing beverages, this invention may also be used to advantage in other liquid dispensing applications.

24 Claims, 7 Drawing Sheets

BAG-IN-BOX CONTAINER FOR LIQUIDS

CROSS-REFERENCE TO RELATED APPLICATIONS

This application is the national stage of International Application No. PCT/US 01/12197 filed Apr. 13, 2001, which claims priority from U.S. Provisional Application Ser. No. 60/197,026 filed on Apr. 13, 2000.

BACKGROUND OF THE INVENTION

1. Field of the Invention

This invention relates generally to an apparatus for containing and dispensing liquid. More specifically, this invention is directed to an improved box and bag for a bag-in-box apparatus.

2. Description of the Related Art

In the field of post-mix beverage systems, an apparatus commonly known as a bag-in-box package is used to store and dispense beverages such as soft drinks. Typically, such bag-in-box packages comprise a collapsible bag or bladder disposed within a cardboard or plastic box. The bag has a spout for filing the bag with liquid, and the spout protrudes through a wall of the box for dispensing the liquid from the bag, usually by connection to a pump. One of the problems associated with such bag-in-box packages is that the bag collapses upon itself as the liquid is withdrawn, which tends to create pockets of liquid that are isolated from the spout and cannot be withdrawn from the bag. Thus, the residual portion of liquid remaining in the bag is wasted.

One possible solution to the foregoing problem is to place an evacuation strip inside the bag as shown, for example, in U.S. Pat. No. 5,749,493 to Boone et al. The bag of the '493 patent contains an elongated, narrow, flexible evacuation strip comprising a plurality of upstanding ribs. The evacuation strip is attached to the inner surface of one of the bag walls. A spout is disposed through a wall of the bag, and the evacuation strip is in liquid communication with the spout. As the bag collapses upon withdrawal of the liquid through the spout, the ribs of the evacuation strip prevent the walls of the bag from isolating pockets of liquid from the spout. The evacuation strip thus enables substantially complete withdrawal of the liquid from the bag. However, the evacuation strip adds an extra complication to the bag manufacturing process.

Another possible attempt to solve the problem of incomplete withdrawal of the liquid from such bag-in-box packages is to place the packages on slanted racks. By orienting the package such that the spout is at the lowest possible point, gravity will assist in forcing the liquid toward the spout. However, the need for a special slanted rack is a disadvantage to such an arrangement.

In light of the foregoing disadvantages, it would be a significant advancement in the art of liquid dispensing to provide a bag-in-box package that would enable substantially complete withdrawal of the liquid from the container without the use of an evacuation strip or a slanted rack.

SUMMARY OF THE INVENTION

Accordingly, this invention is directed to an improved box and bag of a bag-in-box apparatus for containing and dispensing liquids such as beverages. The interior surface of the bottom of the box is preferably sloped or terraced downward toward the spout of the bag such that gravity helps feed the liquid toward the spout. In this manner, the present invention reduces the amount of residual liquid as the liquid is withdrawn from the bag. Although the primary intended application of the present invention is in bag-in-box packages for containing and dispensing beverages, this invention may also be used to advantage in other liquid dispensing applications.

BRIEF DESCRIPTION OF THE DRAWINGS

This invention may best be understood by reference to the following drawings.

DETAILED DESCRIPTION OF A PREFERRED EMBODIMENT

Figure 2:
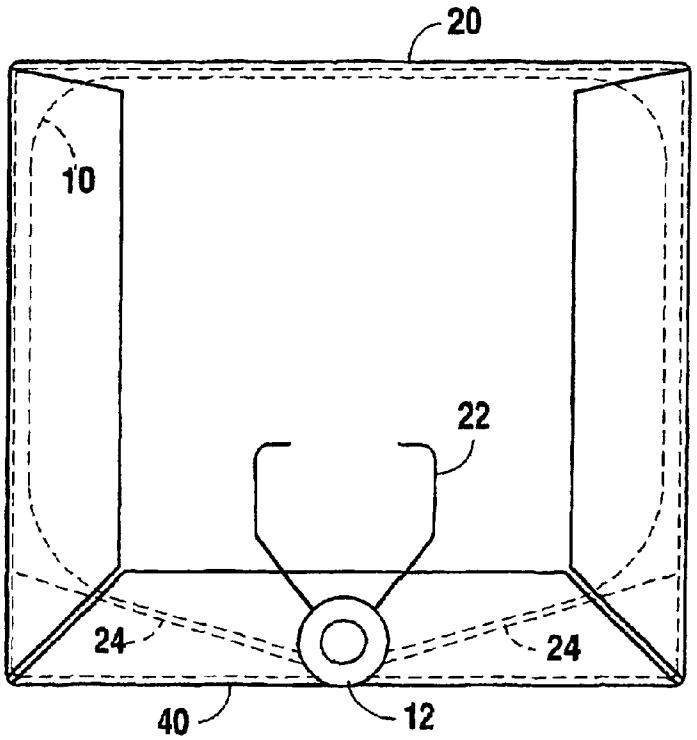
FIG. 2 is a front elevational view of the box of FIG. 1 having a collapsible bag disposed therein.
Figure 1:
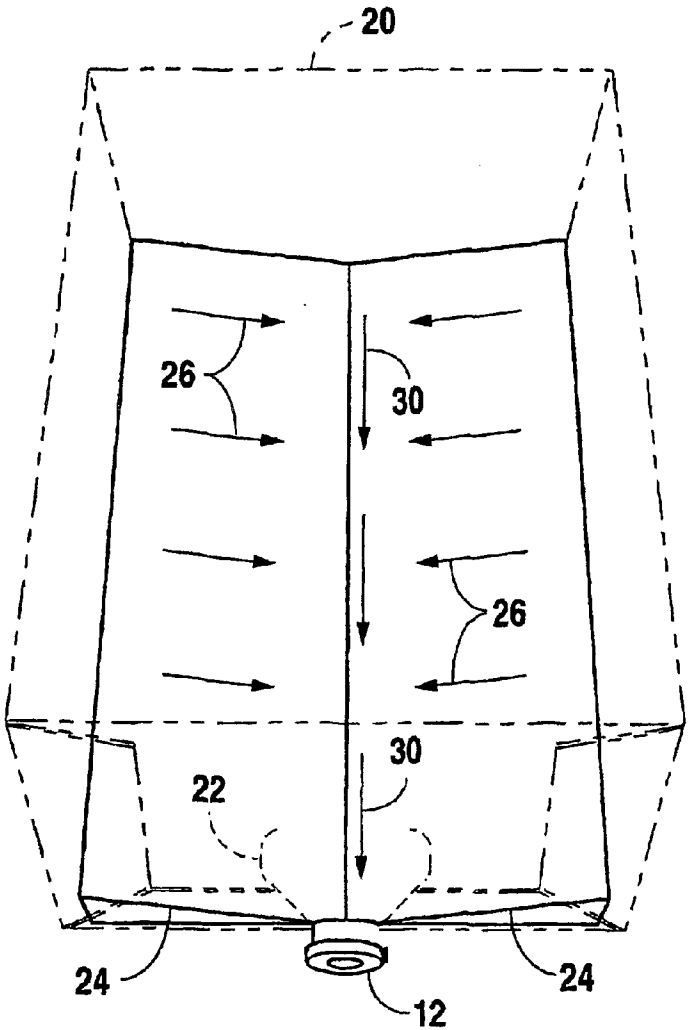
FIG. 1 is a perspective view of a box in accordance with the present invention.
Figure 3:
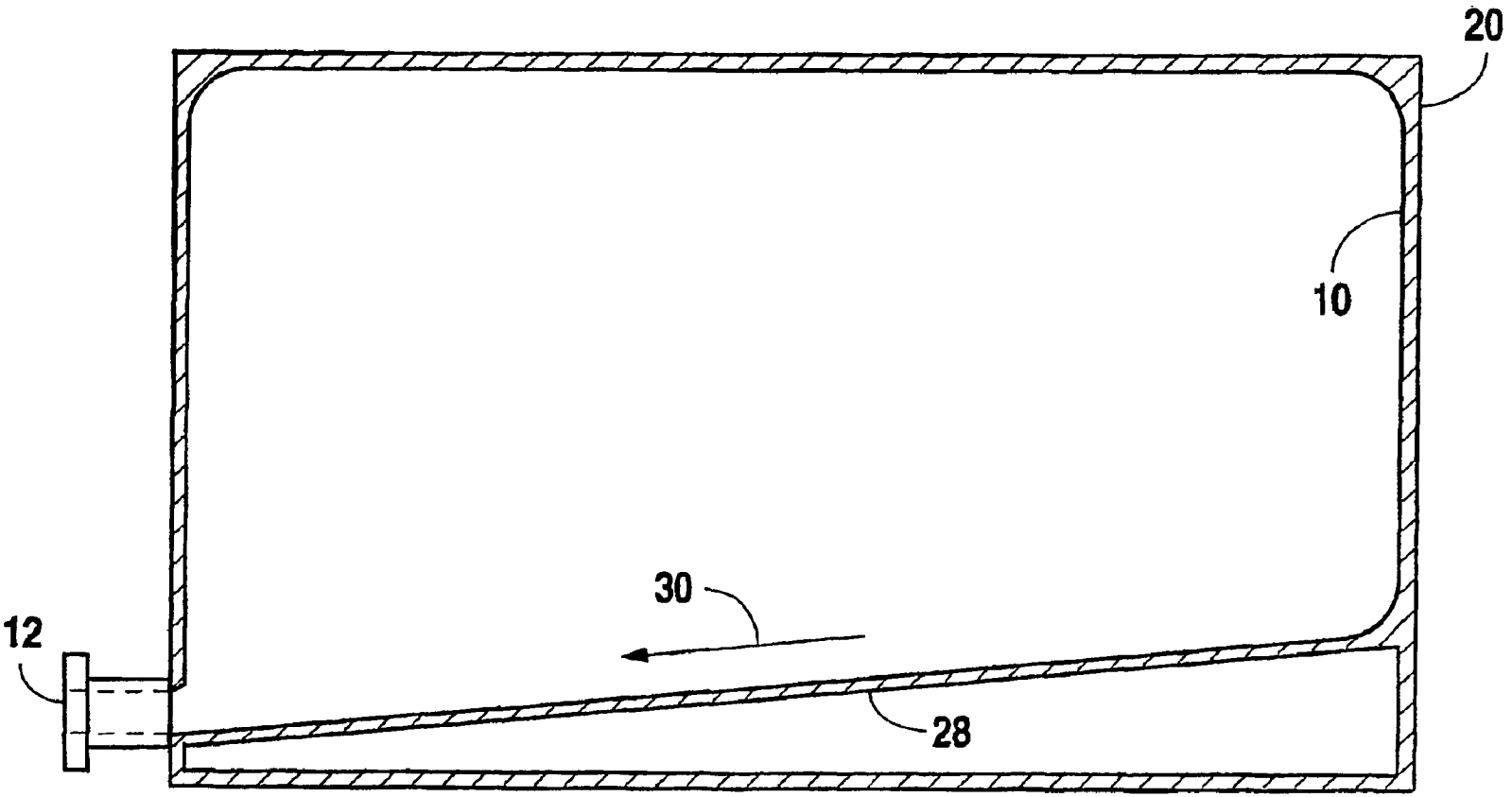
FIG. 3 is a side cross-sectional view of the box of FIG. 1 having a collapsible bag disposed therein.

Referring to FIGS. 1–3, a preferred embodiment of this invention comprises a box 20 having an interior bottom surface that is sloped, preferably both laterally and longitudinally. That is, the interior bottom surface is sloped laterally along lines 24 as depicted by arrows 26 and longitudinally along line 28 as depicted by arrows 30. The exterior bottom surface 40 is flat (horizontal) like a conventional box. Box 20 has a flap opening 22 for receiving a spout 12 of a collapsible bag 10 disposed within box 20. Together, bag 10 and box 20 form a bag-in-box apparatus which is useful for containing and dispensing a liquid such as a beverage (not shown). Typically, a pump (not shown) is indirectly connected to spout 12 via a hose and connector (not shown) for dispensing the liquid. When filled with liquid, bag 10 will conform to the contour of the interior bottom surface of box 20, and bag 10 is oriented inside box 20 such that spout 12 is located at or near the lowest point of the interior bottom surface of box 20. As the liquid is withdrawn from bag 10, gravity causes the liquid to seek the lowest point in box 20 (i.e., spout 12), which assists in withdrawal of the liquid. As used herein, the term "lateral" denotes a direction generally transverse to spout 12, and "longitudinal" denotes a direction generally parallel to spout 12.

Due to the lateral and longitudinal sloping of the interior surface of the bottom of box 20, the liquid moves toward spout 12. The velocity of the liquid at spout 12 will be greater than in other regions of the liquid. This higher velocity creates a low pressure region which in turn pulls more liquid toward spout 12 for improved drainage. This phenomenon is governed by the equation $$P_1+\tfrac{1}{2}\rho V_1^2=P_2+\tfrac{1}{2}\rho V_2^2 \qquad \text{Eq. [1]}$$

where P represents static pressure, ρ represents the density of the liquid (which is assumed to be constant), V represents the velocity of the liquid, and subscripts 1 and 2 represent two different locations in the liquid. The quantity $\tfrac{1}{2}\rho V^2$ represents the dynamic pressure at a particular point in the liquid. If point 2 is chosen at spout 12 and point 1 is chosen at a location in the fluid remote from spout 12, one may assume that $V_2 >> V_1$, and Eq. [1] simplifies to $$P_2=P_1-\tfrac{1}{2}\rho V_2^2 \qquad \text{Eq. [2]}$$

Equation [2] indicates that the static pressure at spout 12 is lower than at other locations in the liquid, which draws the liquid toward spout 12.

Figure 6:
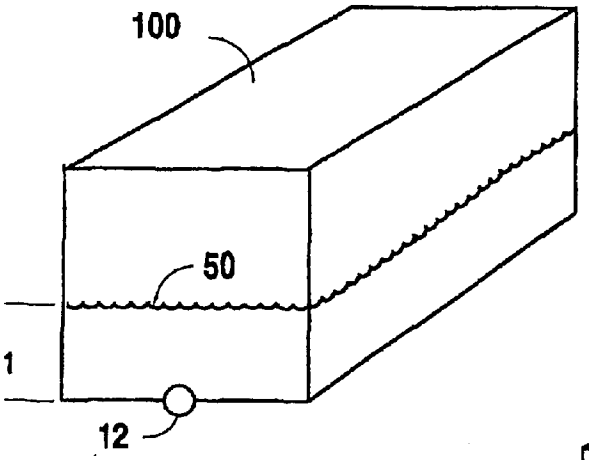
FIG. 6 is a schematic perspective view of a conventional bag-in-box package having a flat, horizontal bottom.
Figure 7:
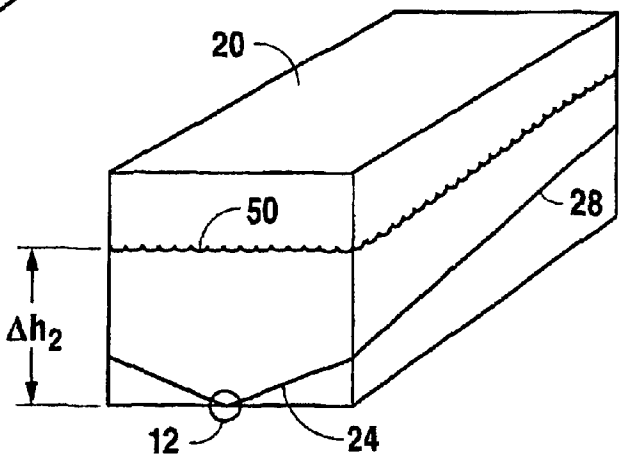
FIG. 7 is a schematic perspective view of a bag-in-box package in accordance with the present invention.

FIGS. 6 and 7 illustrate another advantage of the present invention in providing improved flow of liquid. FIG. 6 depicts a conventional box 100 with a horizontal interior bottom surface containing a certain volume of liquid 50 in a bag (not shown), and FIG. 7 depicts a box 20 with a sloped interior bottom surface 24, 28 in accordance with the present invention containing the same volume of liquid 50 as FIG. 6 in a bag (not shown). The height ($\Delta h_2$) of the liquid 50 above spout 12 in the sloped box 20 of FIG. 7 is greater than the height ($\Delta h_1$) of the liquid 50 above spout 12 in the conventional box 100 of FIG. 6. This increased height increases the static pressure at spout 12, which results in better liquid flow when the pump is activated and also delays the onset of starvation of the pump. This phenomenon is illustrated by the equation $$P_{ref}+\tfrac{1}{2}\rho V_1^2+\rho g h_1=P_{ref}+\tfrac{1}{2}\rho V_2^2+\rho g h2 \qquad \text{Eq. [3]}$$

where $P_{ref}$ is the static pressure at a reference level in the liquid, ρ is the density of the liquid (which is assumed to be constant), V is the velocity of the liquid, g is the gravitational constant, h is the difference in height of the liquid from the reference level down to the level of interest, and subscripts 1 and 2 represent two different locations in the liquid. If point 1 is chosen at the top of the liquid 50 above spout 12 and point 2 is chosen at spout 12, then $V_2 >> V_1$ and Eq. [3] simplifies to $$V_2^2=2g\Delta h \qquad \text{Eq. [4]}$$

where $\Delta h=|h_1-h_2|$ is the height of the head of liquid 50 above spout 12. Thus, as Δh increases, the velocity at spout 12 increases. Because $\Delta h_2$ in FIG. 7 is greater than $\Delta h_1$ in FIG. 6, the flow at spout 12 is better (i.e., has a higher velocity) in the configuration of FIG. 7 than in the configuration of FIG. 6 for the same volume of liquid in the container. The sloped design of FIG. 7 also serves to delay the collapse of the bag until substantially all of the liquid is withdrawn.

To minimize the residual liquid, the opening of spout 12 should be at or below the lowest point on the interior bottom surface of box 20. The longitudinal and lateral sloping of the interior bottom surface of box 20 may be accomplished by sloping the box itself (i.e., an integral structure) or by adding an insert inside the box. The insert or box bottom could be made of a variety of materials, such as fiberboard, corrugate, wood, plastic, metal, fiberglass, expanded foam, or any other suitable material, which could be recycled or virgin.

Figure 5:
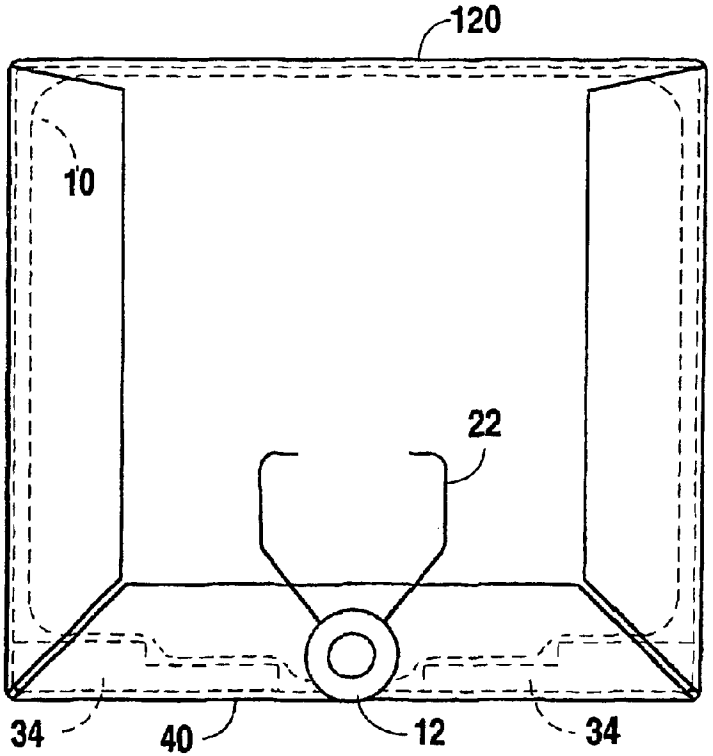
FIG. 5 is a front elevational view of the box of FIG. 4 having a collapsible bag disposed therein.
Figure 4:
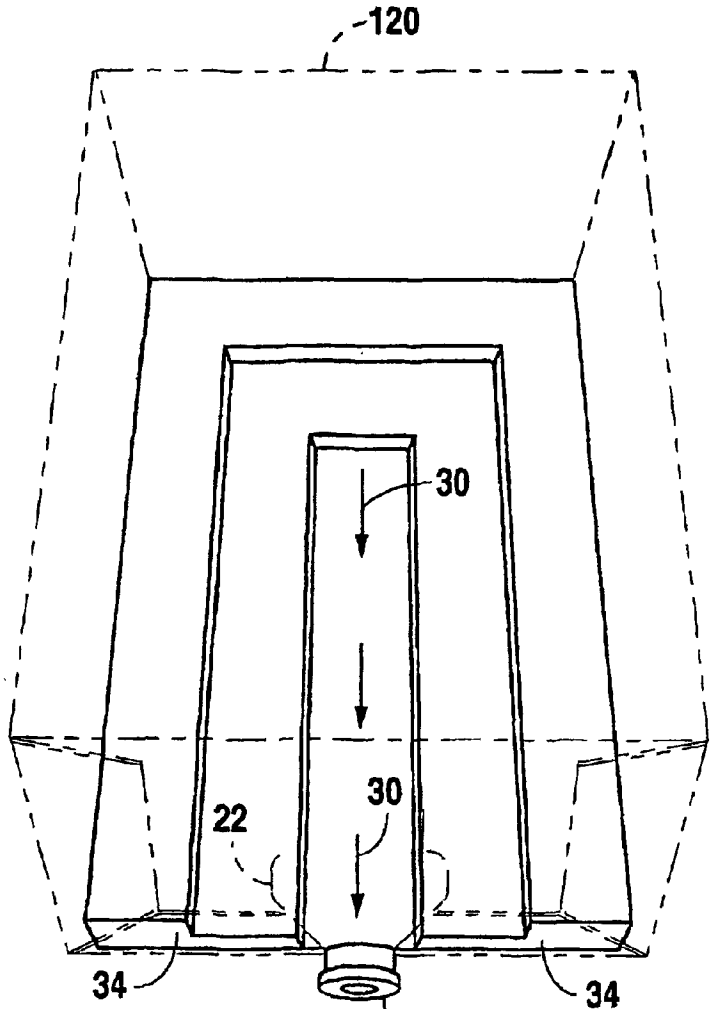
FIG. 4 is a perspective view of an alternative embodiment of a box in accordance with the present invention.
Figure 8:
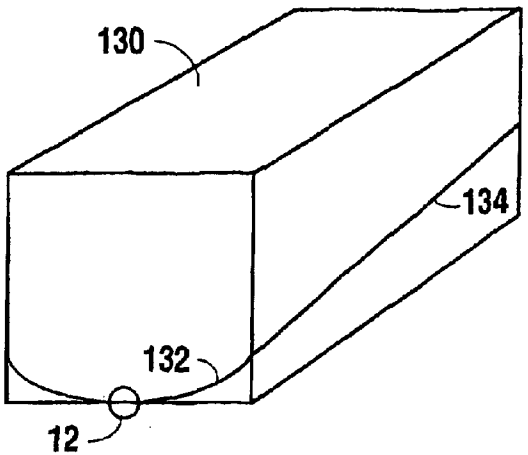
FIG. 8 is a schematic perspective view of an alternative bag-in-box package in accordance with the present invention.
Figure 9:
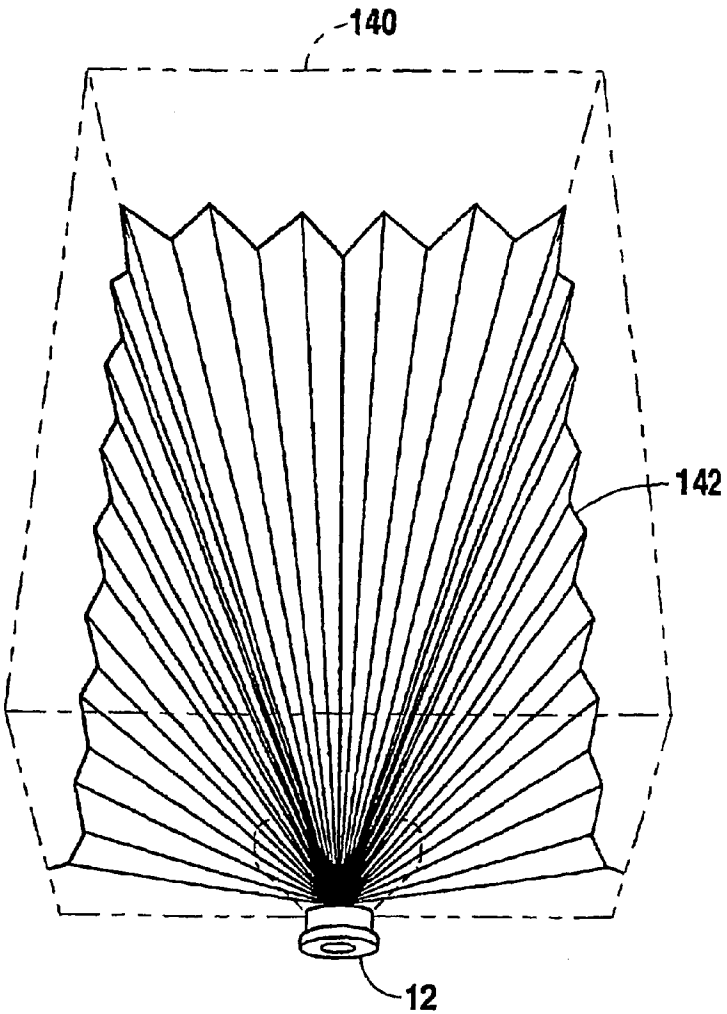
FIG. 9 is a perspective view of another alternative box in accordance with the present invention.
Figure 12:
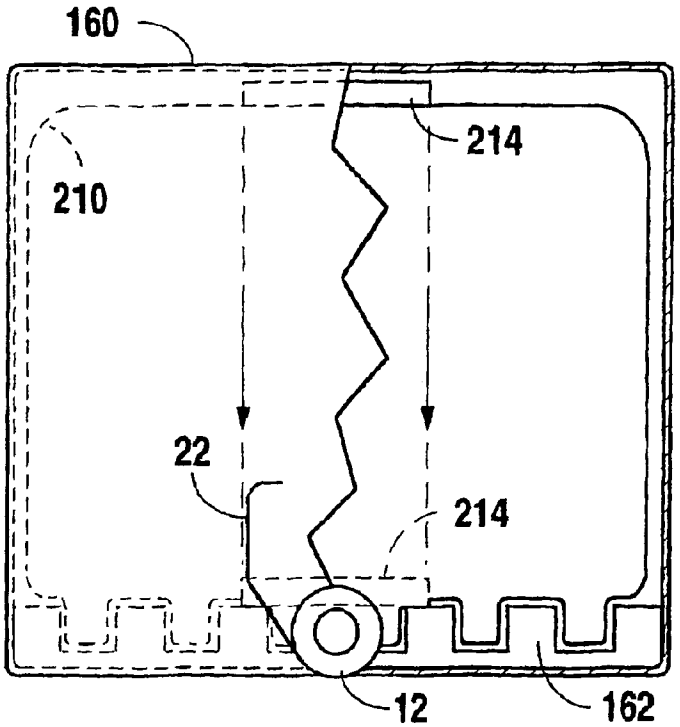
FIG. 12 is a front elevational view of still another box in accordance with the present invention having an alternative collapsible bag disposed therein.
Figure 11:
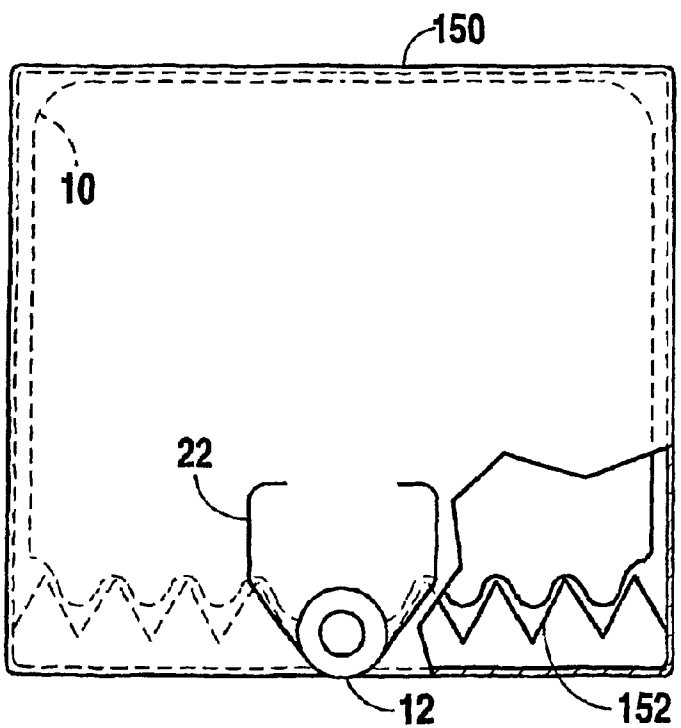
FIG. 11 is a front elevational view of yet another box in accordance with the present invention.

The sloped interior bottom surface of box 20 may be replaced with several alternative configurations. For example, as shown in FIGS. 4 and 5, the interior bottom surface of box 120 may comprise terraces 34. Alternatively, the interior bottom surface of the box may comprise curves 132, 134 as shown on box 130 of FIG. 8, fans 142 as shown on box 140 of FIG. 9, corrugations 152 as shown on box 150 of FIG. 11, or beams 162 as shown on box 160 of FIG. 12. Furthermore, the foregoing types of box bottom structure may be combined in various combinations for the interior bottom surface of the box, and any given type of structure may have any desirable number of slopes, terraces, curves, fans, corrugations, or beams, as the case may be. Although it is contemplated that the exterior bottom surface of the box will be substantially planar and horizontal during use for the sake of simplicity and compatibility with conventional horizontal shelves or racks, the exterior bottom surface of the box may have any desirable configuration so long as the interior bottom surface of the box is configured so as to urge a liquid contained in a collapsible bag disposed within the box toward the bag spout under the influence of gravity due to a difference in elevation on the interior bottom surface.

Figure 10:
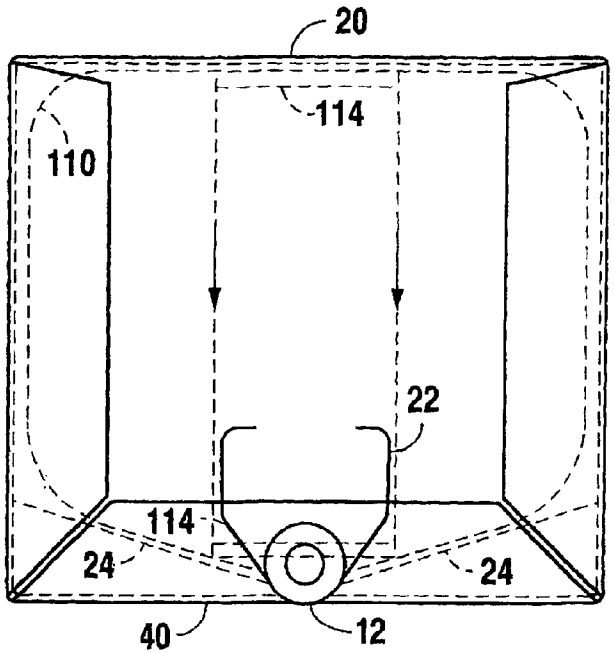
FIG. 10 is a front elevational view of the box of FIG. 2 having an alternative collapsible bag disposed therein.

To further guard against the complete collapse of the bag upon itself and the consequent trapping of residual liquid inside the bag, a stiffener 114 may be provided along the top surface of the bag 110 as shown in FIG. 10. As the liquid is withdrawn from bag 110, stiffener 114 gradually approaches the bottom of box 20, and the outer edges of stiffener 114 eventually come to rest upon slopes 24 leaving a gap between stiffener 114 and the bottom of bag 110 so that liquid may pass through spout 12. Stiffener 114 may be provided on the interior of the top of bag 110 as shown in FIG. 10, or stiffener 214 may be provided on the exterior of bag 210 as shown inside box 160 of FIG. 12. Such a stiffener, which could be integral to the bag itself or a separate member attached to the bag by suitable means such as heat sealing or adhesive, may be used to advantage in conjunction with any type of box bottom as disclosed herein.

Figure 13:
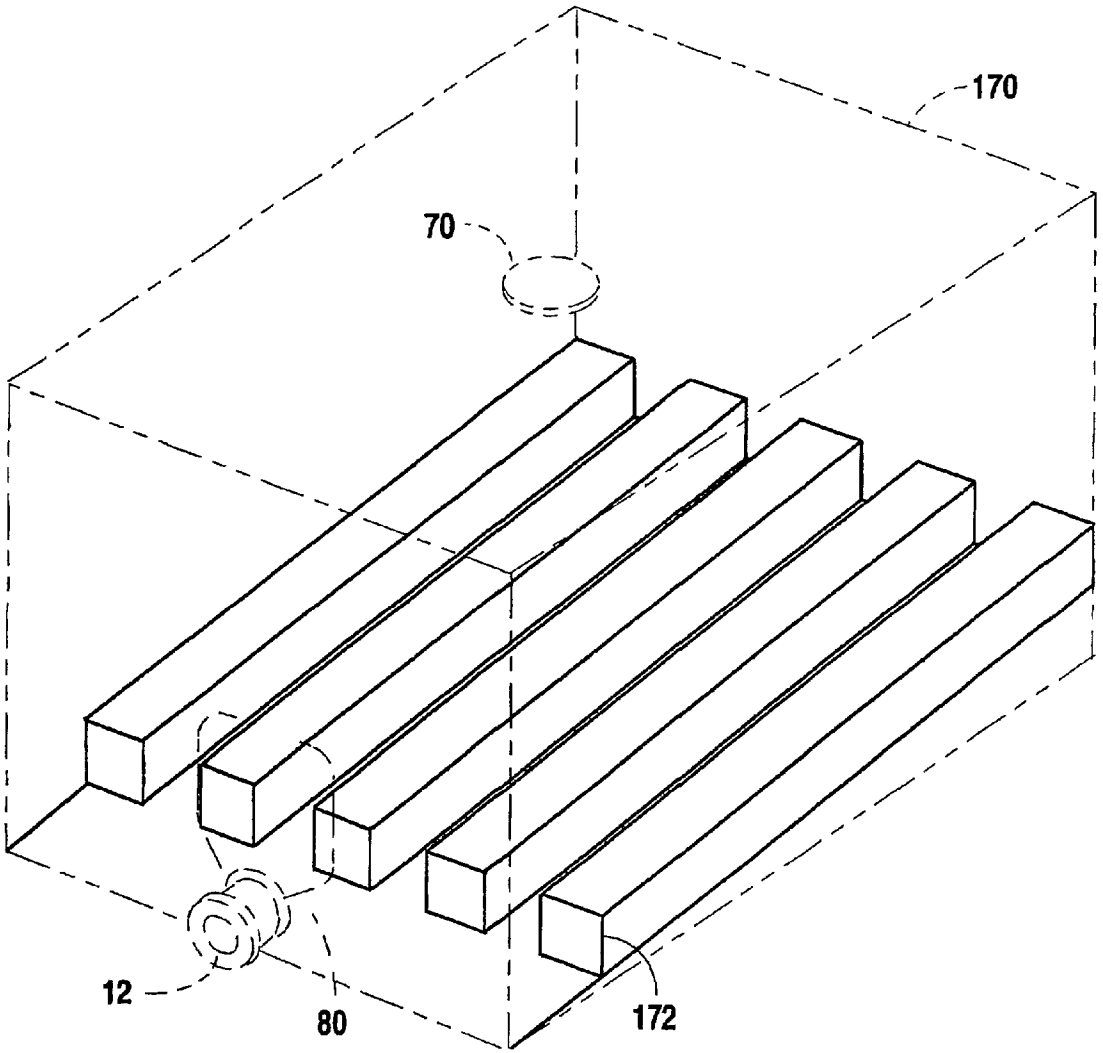
FIG. 13 is a perspective view of yet another alternative box in accordance with the present invention.

FIG. 13 illustrates a box 170 having beams 172 on its interior bottom surface. Beams 172 stop short of spout 12 to form a collection zone 80 in the vicinity of spout 12 to assist in the withdrawal of liquid from the bag (not; shown). As an additional safeguard against the collapse of the bag, the top of the bag (not shown) may be attached to the top of the box 170 using a suitable means of attachment 70, such as hook-and-loop fasteners, snaps, or adhesives.

Although the foregoing specific details describe a preferred embodiment of this invention, persons reasonably skilled in the art of liquid dispensing will recognize that various changes may be made in the details of the apparatus of this invention without departing from the spirit and scope of the invention as defined in the appended claims. Therefore, it should be understood that this invention is not to be limited to the specific details shown and described herein.

We claim:

1. A box for receiving a collapsible bag, the bag having a spout and being capable of containing and dispensing a liquid, said box comprising:

an interior bottom surface for supporting the collapsible bag, said interior bottom surface comprising a first location and a second location, there being a difference in elevation between said first and second locations, said interior bottom surface having at least one portion selected from the group consisting of terrace, corrugation, fan, and beam; and a wall adjacent said interior bottom surface, said wall having an opening for receiving the spout of the collapsible bag;

wherein a liquid contained in the collapsible bag will be urged toward the spout under the influence of gravity due to said difference in elevation.

2. The box of claim 1 wherein said interior bottom surface further comprises at least one slope.

3. The box of claim 2 wherein said at least one slope comprises a lateral slope.

4. The box of claim 2 wherein said at least one slope comprises a longitudinal slope.

5. The box of claim 2 wherein said at least one slope comprises a lateral slope and a longitudinal slope.

6. The box of claim 1 wherein said interior bottom surface is integral to said box.

7. The box of claim 1 wherein said interior bottom surface is provided by an insert to said box.

8. The box of claim 1 further comprising a substantially horizontal exterior bottom surface.

9. The box of claim 1 wherein said difference in elevation allows substantially complete withdrawal of liquid from the collapsible bag.

10. A bag-in-box apparatus for containing and dispensing a liquid, said apparatus comprising:

a collapsible bag having a spout; and a box comprising an interior bottom surface having a first location and a second location, there being a difference in elevation between said first and second locations, said interior bottom surface having at least one portion selected from the group consisting of terrace, corrugation, fan, and beam, said box further comprising a wall adjacent said interior bottom surface, said wall having an opening therein, said collapsible bag being disposed within said box, said spout being disposed through said opening in said wall;

wherein a liquid contained in said collapsible bag will be urged toward said spout under the influence of gravity due to said difference in elevation.

11. The apparatus of claim 10 wherein said interior bottom surface further comprises at least one slope.

12. The apparatus of claim 11 wherein said at least one slope comprises a lateral slope.

13. The apparatus of claim 11 wherein said at least one slope comprises a longitudinal slope.

14. The apparatus of claim 11 wherein said at least one slope comprises a lateral slope and a longitudinal slope.

15. The apparatus of claim 10 wherein said interior bottom surface is integral to said box.

16. The apparatus of claim 10 wherein said interior bottom surface is provided by an insert to said box.

17. The apparatus of claim 10 wherein said box further comprises a substantially horizontal exterior bottom surface.

18. The apparatus of claim 10 wherein said difference in elevation allows substantially complete withdrawal of liquid from said collapsible bag.

19. The apparatus of claim 10 wherein said bag comprises a stiffener that cooperates with said interior bottom surface as said bag collapses to allow substantially complete withdrawal of liquid from said bag.

20. The apparatus of claim 10 wherein said box has a top and said bag is attached to said top.

21. A box for receiving a collapsible bag, the bag having a spout and being capable of containing and dispensing a liquid, said box comprising:

an insert forming an interior bottom surface of said box for supporting the collapsible bag, said interior bottom surface comprising a first location and a second location, there being a difference in elevation between said first and second locations, said interior bottom surface having at least one portion selected from the group consisting of terrace and corrugation; and a wall adjacent said interior bottom surface, said wall having an opening for receiving the spout of the collapsible bag;

wherein a liquid contained in the collapsible bag will be urged toward the spout under the influence of gravity due to said difference in elevation.

22. A bag-in-box apparatus for containing and dispensing a liquid, said apparatus comprising:

a collapsible bag having a spout; and a box comprising an insert which forms an interior bottom surface having a first location and a second location, there being a difference in elevation between said first and second locations, said interior bottom surface having at least one portion selected from the group consisting of fan and beam, said box further comprising a wall adjacent said interior bottom surface, said wall having an opening therein, said collapsible bag being disposed within said box, said spout being disposed through said opening in said wall;

wherein a liquid contained in said collapsible bag will be urged toward said spout under the influence of gravity due to said difference in elevation.

23. A bag-in-box apparatus for containing and dispensing a liquid, said apparatus comprising:

a collapsible bag having a spout and a stiffener; and a box comprising an interior bottom surface having a first location and a second location, there being a difference in elevation between said first and second locations, said box further comprising a wall adjacent said interior bottom surface, said wall having an opening therein, said collapsible bag being disposed within said box, said spout being disposed through said opening in said wall;

wherein a liquid contained in said collapsible bag will be urged toward said spout under the influence of gravity due to said difference in elevation and wherein said stiffener cooperates with said interior bottom surface as said bag collapses to allow substantially complete withdrawal of liquid from said bag.

24. The apparatus of claim 23 wherein said stiffener is substantially flat.

* * * * *

UNITED STATES PATENT AND TRADEMARK OFFICE

CERTIFICATE OF CORRECTION

PATENT NO. : 6,827,237 B2
APPLICATION NO. : 10/257335
DATED : December 7, 2004
INVENTOR(S) : Kendall L. Yorn and Frank L. Provenza It is certified that error appears in the above-identified patent and that said Letters Patent is hereby corrected as shown below:

In the drawings, Sheet 4, Fig. 6, the numeral "1" in the lower left portion between the two dimensional extension lines should be replaced with --$\Delta h_1$-- and associated dimensional arrows should be added to indicate the height between the dimensional extension lines.

In column 3, line 37, the last "2" in Eq. [3] should be a subscript.

Signed and Sealed this

Sixteenth Day of January, 2007

JON W. DUDAS
*Director of the United States Patent and Trademark Office*